US005344041A

United States Patent [19]

Luburic et al.

[11] Patent Number: 5,344,041

[45] Date of Patent: Sep. 6, 1994

[54] BAIL FOR CONTAINER AND ATTACHMENT MEANS THEREFOR

[75] Inventors: Frano Luburic, Fullerton; Dennis R. Willis, Corona, both of Calif.

[73] Assignee: Ropak Corporation, Fullerton, Calif.

[21] Appl. No.: 121,338

[22] Filed: Sep. 14, 1993

[51] Int. Cl.[5] ..... B65D 25/32

[52] U.S. Cl. ..... 220/760; 220/770; 220/776

[58] Field of Search ..... 220/760, 770, 776, 775, 220/759; 16/114 R, 110.5

[56] References Cited

U.S. PATENT DOCUMENTS

| | | | |
|---|---|---|---|
| 472,130 | 4/1892 | Lusk | 220/760 |
| 2,176,711 | 10/1939 | Gorman, Jr. | 220/776 |
| 3,128,905 | 4/1964 | Hesslein | 220/760 |
| 4,071,939 | 2/1978 | Bock | 220/760 |
| 4,240,554 | 12/1980 | Bock | 220/760 |

FOREIGN PATENT DOCUMENTS

| | | | |
|---|---|---|---|
| 722573 | 1/1955 | United Kingdom | 220/776 |
| 2168238 | 6/1986 | United Kingdom | 220/776 |
| 2244972 | 12/1991 | United Kingdom | 220/770 |

*Primary Examiner*—Stephen Castellano
*Attorney, Agent, or Firm*—Thomas P. Mahoney

[57] ABSTRACT

A container bail incorporates securement means cooperative with retaining means on a container, said securement means having a head receivable in a receptor opening in the retaining means which is of totally different size and configuration from the receptor opening in the securement means which creates an interference fit materially reducing the likelihood of inadvertent dislodgement of the securement means from the retaining means. The bail also incorporates flexibility at critical points which augments the tendency of the retaining means to remain operatively associated with the securement means.

11 Claims, 3 Drawing Sheets

BAIL FOR CONTAINER AND ATTACHMENT MEANS THEREFOR

This invention relates to a bail construction for a container and, more particularly, to a bail construction which includes receptor and locating socket means provided upon the container with which the bail is associated and securement means on said bail cooperative with said socket means.

BACKGROUND OF THE INVENTION

Various types of prior art containers for both domestic and industrial utilization have incorporated bails which serve as handles for the containers. Most commonly, bails are provided in the form of U-shaped wire members having right angularly bent extremities which are spring-biased into corresponding openings provided on the wall of the container.

This particular type of construction has been utilized in containers fabricated from both metal and synthetic plastic. However, such conventional wire bails can be easily dislocated from engagement with the mounting openings therefor and, in addition, they are subject to oxidization and require the provision of a separate handle which is mounted intermediate the extremities thereof.

Since the introduction of containers fabricated from synthetic plastics, numerous attempts have been made to provide bails fabricated from the same material as the container itself. However, some difficulty has been encountered in providing adequate mounting means for the bails on the container with which they are associated. This is due to the fact that the most common form of attachment of plastic bails to associated plastic containers involves what is known as keyhole slots which incorporate conventionally shaped keyhole openings constituting receptor and locating means for corresponding and cooperating members on the extremities of the bail.

Unfortunately, such conventional expedients have not been successful because, conventionally, the engagement means on the opposite extremities of the bail have been sized to fit easily within the keyhole slots and, therefore, to be as easily disengaged therefrom. Consequently, there has been a tendency in the industry to abandon the utilization of plastic bails in favor of the relatively primitive wire bails and associated handles.

One of the major factors contributing to the aforesaid inadvertent disengagement of the engagement means of plastic bails from the associated keyhole openings is the relative rigidity of the bail and the opposite extremities thereof which support the aforesaid engagement means. Consequently, when the extremities of the bail are subjected to eccentric loading, as by the grasping of a bail at the side, rather than the center thereof, the rigid lever arm constituted by the adjacent extremity of the bail causes the engagement means on said extremity to pop out of the keyhole-shaped slot on the container.

OBJECTS AND ADVANTAGES OF THE INVENTION

It is, therefore, an object of the invention to provide a bail fabricated from synthetic plastic having engagement or securement means on its opposite extremities engagable with bail retaining means on an associated container whereby, once the securement means on said extremities has been inserted into operative relationship with said bail retaining means, the possibility of inadvertent dislodgement of said extremities from operative engagement with the container is substantially eliminated.

Another object of the invention is the provision of cooperative bail retaining means on a container which includes a socket having an enlarged receptor portion or opening and a reduced locating portion or opening, the bail having securement means on its opposite extremities engagable with said receptor and locating openings and being in the form of an enlarged head a a reduced shank, the enlarged head being larger than the receptor opening and the shank being larger than the locating opening.

Because the head of the securement means on the bail is larger than the receptor opening, the head must be engaged with said retaining means by forcible insertion of the head in said opening, said insertion causing mutual deflection of the engaged portions of the wall of the opening and the head.

Consequently, once the head has been forcibly inserted through the receptor opening, the possibility of inadvertent dislodgement thereof from engagement with the socket means is located.

A further object of the invention is the provision of a bail which includes reinforcing ribs on opposite arms thereof terminating short of the extremities of the bail and the intermediate portion of the bail, and providing a centrally located integral hand grip portion which, in addition to facilitating the gripping of the bail, provides a continuum for loads transmitted through the arms of the bail as rigidified by the aforesaid ribs.

Other objects and advantages of the invention will be apparent from the drawings and specifications.

PREFERRED EMBODIMENT OF THE INVENTION

Figure 3:
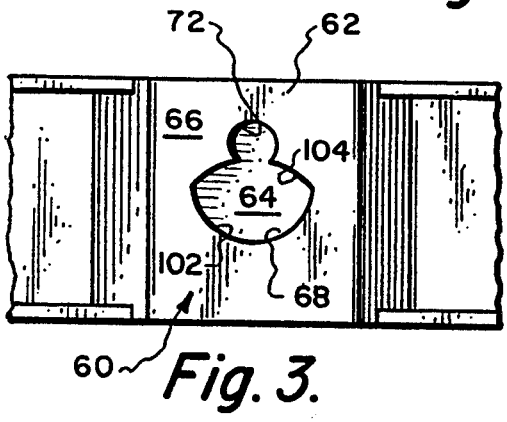
FIG. 3 is a side elevational view of a retaining means constructed in accordance with the teachings of the invention.

Referring to the drawings, and particularly to FIG. 3 thereof, a container 10 includes a bottom, not shown, and an upwardly extending sidewall 12 of substantially cylindrical configuration. The container 10 is fabricated from linear polyethylene synthetic plastic by the utilization of the injection molding process. A cover 14 is provided on the container 10. Although a cylindrical container fabricated from a particular material is shown, the teachings of the invention can be applied with equal cogency to different shapes of container fabricated from different materials other than linear polyethylene and by processes other than injection molding.

Figure 8:
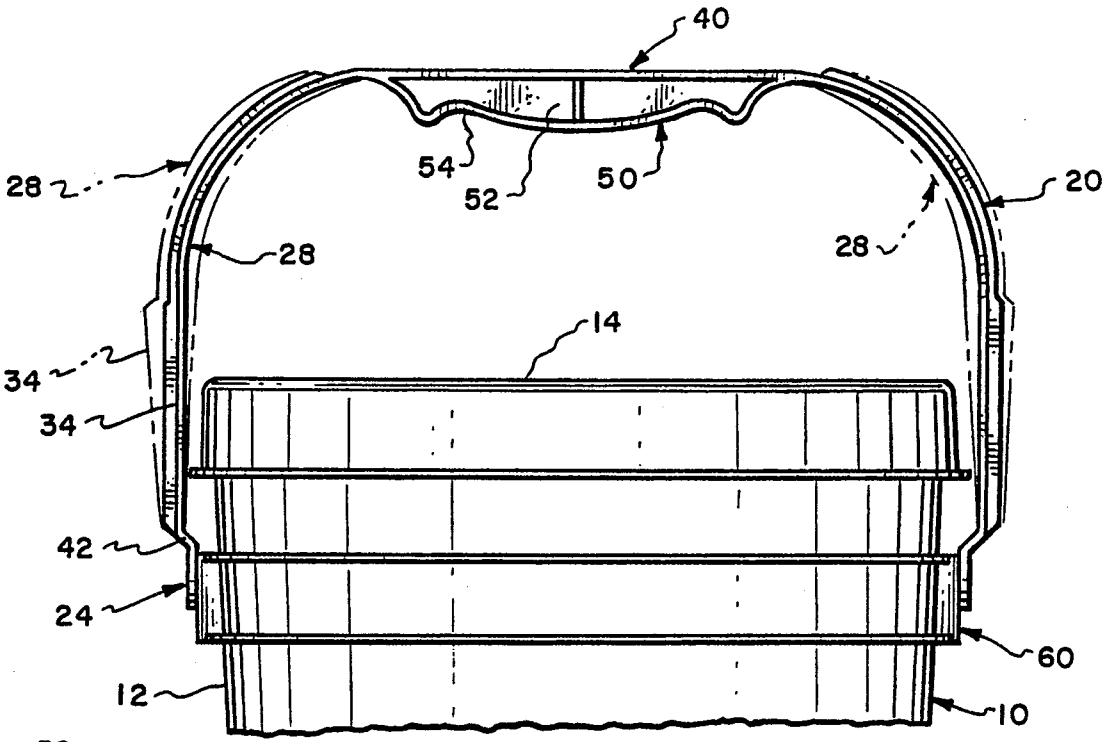
FIG. 8 is a fragmentary elevational view showing the deflection of the arms of the bail.
Figure 9:
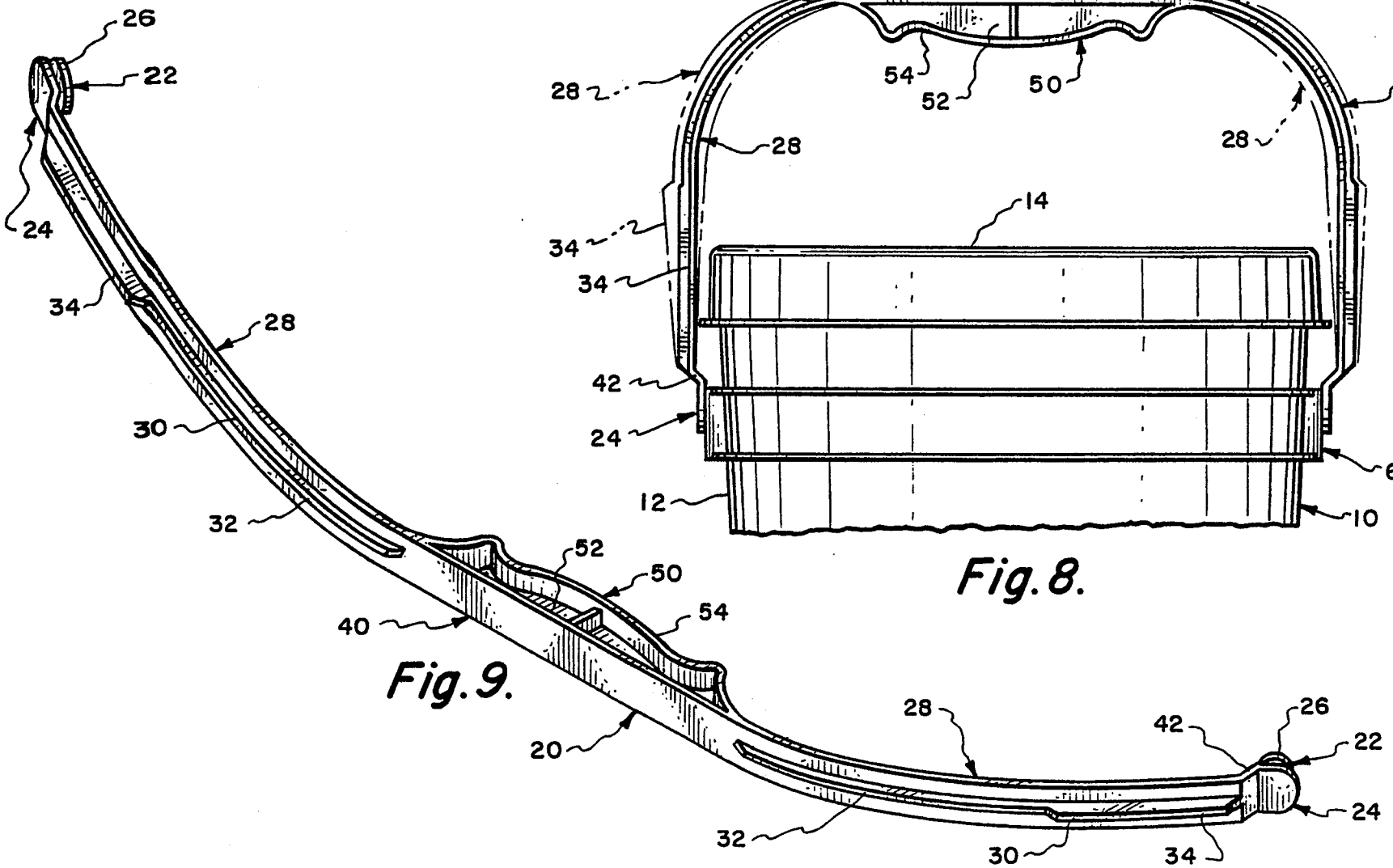
FIG. 9 is an isometric view showing a bail of the invention prior to its installation in operative relationship with the associated container.

Pivotally mounted on the wall 12 of the container 10 is a bail 20 constructed in accordance with the teachings of the invention and fabricated from linear polyethylene by utilization of the injection molding process. The bail 20, as best shown in FIGS. 8 and 9 of the drawings, is initially of elongated configuration but, when mounted in operative relationship with the container 10, assumes a substantially U-shaped configuration.

To accomplish the mounting of the bail 20 in operative relationship with the container 10, securement means 22 are provided on the opposite extremities 24 of the bail 20, said securement means including a circular head 26 and a substantially cylindrical shank 28. Any deviation from the cylindrical configuration of the shank 28 is due to the inherent nature of and the requirements of the injection molding process.

When the bail 20 is mounted in operative relationship with the container 10, in a manner to be described in greater detail below, the U-shaped configuration assumed by the bail 20 defines a pair of arms 28 on the bail whose upper surface is provided with reinforcing ribs 30, said reinforcing ribs having lower, more flexible portions 32 and higher, more rigid portions 34 adjacent the extremities 24 of the bail. Thus, the lower portions 32 of the reinforcing ribs 30 adjacent the intermediate section 40 of the bail 20 permit greater flexing of the relevant portions of the arms 28, and the more rigid, higher portions 34 of the ribs 30 render the lower portions of the arms 28 more rigid immediately adjacent the extremities 24 of the bail.

Therefore, when the bail is subjected to loads which would tend to cause the cylindrical heads 26 to pop out of the mounting relationship with the container 10, to be described in greater detail below, the interface connection 42 between the extremities 24 and the ribbed portion 34 of the arms 28 will flex and absorb the load preventing the inadvertent dismounting of the circular head 26 from operative engagement with the container 20.

It will be noted that the upper extremities of the ribs 30 terminate at the intermediate portion 40 of the bail 20 and a hand grip 50 is provided on the underside of the bail 20 at the intermediate portion 40. The hand grip 50 includes a centrally-located web 52 having a sinuously shaped wall 54 thereupon conforming generally to the configuration of the fingers of a hand. The grip 50 also rigidifies the intermediate portion of the bail 20.

The operative relationship between the bail 20 and the container 10 is provided by retaining means 60, said retaining means being provided, in part, by a substantially rectangularly shaped socket housing 62 defining a socket 64, as best shown in FIGS. 3, 5–7, and 10 of the drawings. The retaining means 60 are formed on opposite sides of the wall 12 of the container 10 during the injection molding process and are integral therewith.

Figure 1:
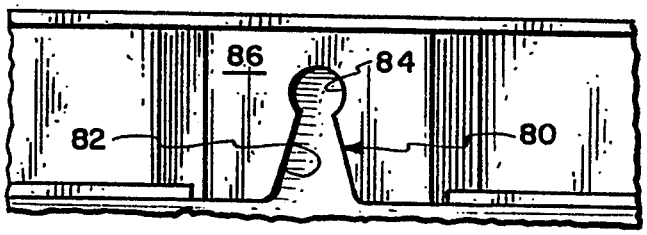
Fig. 1. Prior Art
FIG. 1 is a showing of a prior art bail retaining means.

The housing 62 includes a vertical sidewall 66 which covers the greater portion of the socket 64. Incorporated in the sidewall 66 are receptor openings or portions 68 and locating or retention portions 72, as best shown in the aforesaid figures. Such related openings or portions of a socket construction are conventionally referred to as "keyholes" and the prior art is exemplified in FIGS. 1 and 2 of the drawings wherein FIG. 1 discloses a keyhole construction 80 having an open bottom access opening 82 terminating in a locating opening 84. With this construction, the head of the securement means on the bail is slid under the wall 86 and the shank is advanced upwardly into an interference fit with the wall of the locating opening or portion 84. When the bail is subjected to excessive loads, the shank is dislodged from operative engagement with the opening 84 and the securement means is then apt to fall through the opening 82 and become disengaged from operative relationship with the associated container.

Figure 2:
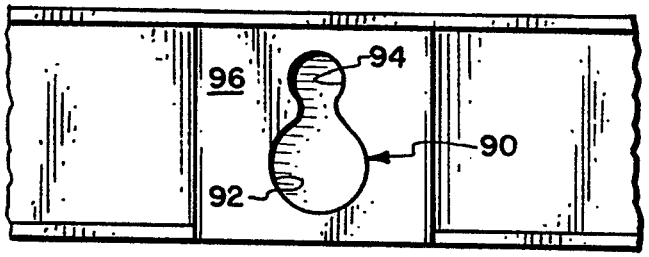
Fig. 2. Prior Art
FIG. 2 shows an alternative prior art retaining means.

Similar considerations apply to the more prevalent keyhole opening shown in FIG. 2 at 90, wherein the enlarged receptor opening or portion 92 is associated with the reduced locating or retention portion 94 defined by the adjacent edges of the vertical wall 96.

In this construction, the circular head of the securement means of the bail fits readily within the receptor portion or opening 92 and the shank is forced upwardly into an interference fit with the wall of the locating opening 94. Once again, when an excessive load is imposed upon the bail, the shank is easily displaced from the opening 94 downwardly to locate the circular head in registration with the edge of the opening 92 permitting the head to spring outwardly from operative engagement with the keyhole construction 90. The interference fit and the snap action between the head 26 and the lower edge 102 of the receptor opening 68 is facilitated by the modulus of deflection between said head and said edge attributable to the inherent nature of the linear polyethylene utilized in the manufacture of the container and the bail.

In contrast to the keyhole constructions of the prior art, the receptor opening or portion 68 is nonsymmetrical and it does not conform in its configuration to the head 26 of the securement means 22. The disparity in the configurations and sizes of the receptor opening 68 and the head 26 of the securement means 22 is shown in phantom in FIG. 10 of the drawings.

It will be noted that there is substantial conformity between the radii of the head 26 and the lower edge 102 of the receptor opening 68 but complete divergence between the head radius and the upper edge 104 of the receptor opening 68. It is readily apparent that the radius on which the upper edge 104 of the opening 68 is drawn is much larger than the radius of the lower edge 102 and the head 26. This disparity in size and radius is the major factor in ensuring that the inadvertent displacement of the bail 20 from operative relationship with the container will not occur. The different radii on the lower edge 102 and upper edge 104 of the receptor opening 68 imparts a lobe shape to the opening 68 in contradistinction to the circular shape of the head 26. Because of the disparity in shapes, the insertion of the securement means 22 in the retaining socket means 60 creates an interference fit between the head 26 and receptor opening 68.

Consequently, the insertion of the head 26 into operative relationship with the retaining means 60 must be accomplished by angularly disposing the upper edge of the head 26 in the opening 68 below the upper edge 104 of the opening 68 and then snapping the head 26 downwardly to cause the head 26 to enter the socket chamber 64.

Figure 10:
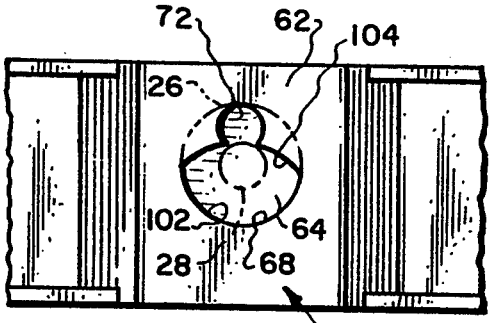
FIG. 10 is a view similar to FIG. 3 showing the approximate size and spatial relationship of the components of the bail mounting means.
Figure 4:
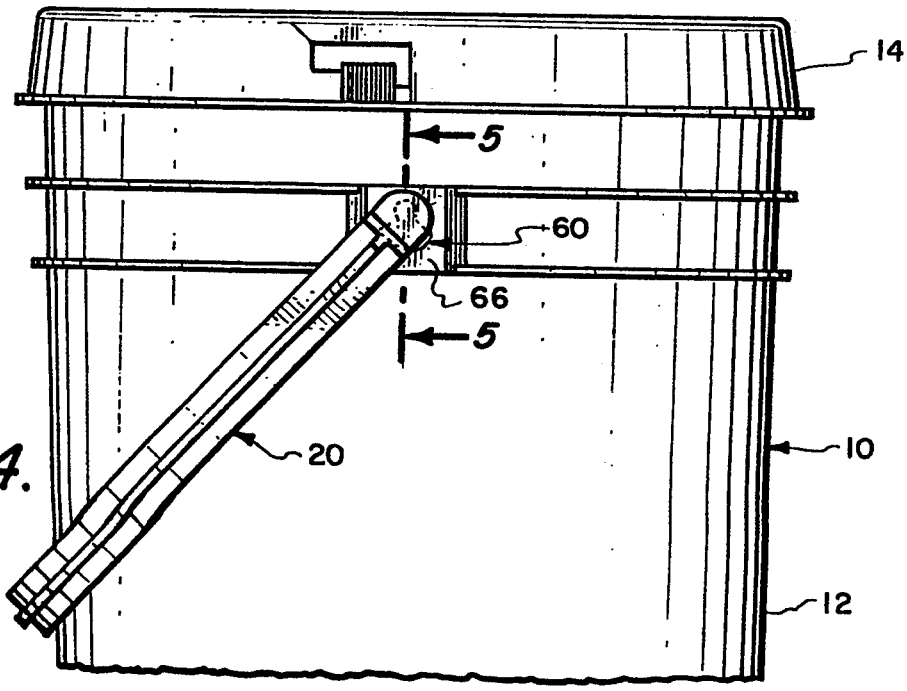
FIG. 4 is a side elevational view showing a bail having one extremity engaged in the aforesaid retaining means.
Figure 5:
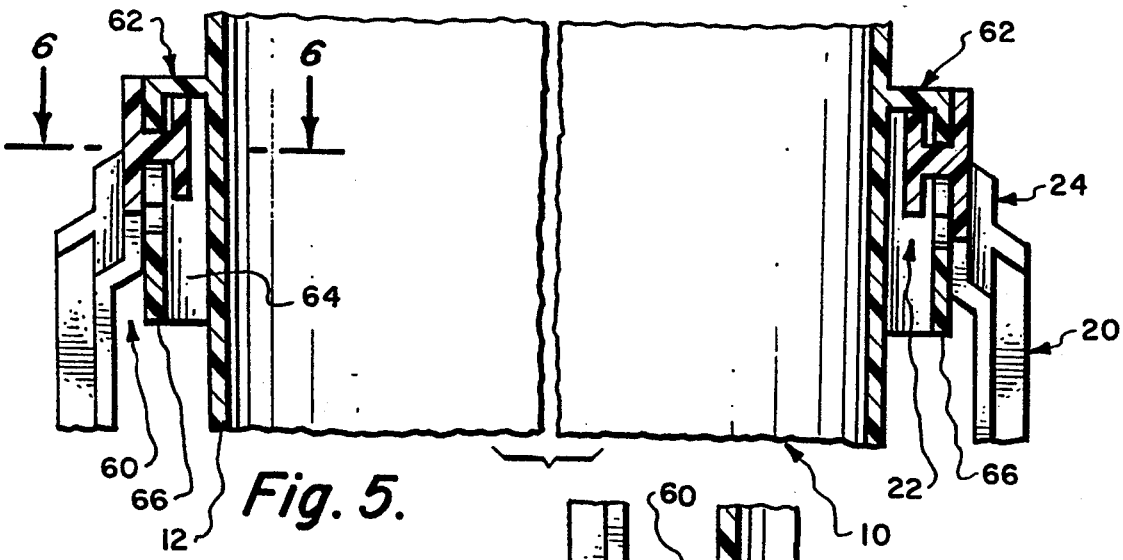
FIG. 5 is a vertical sectional view taken on the broken line 5—5 of FIG. 4.
Figure 6:
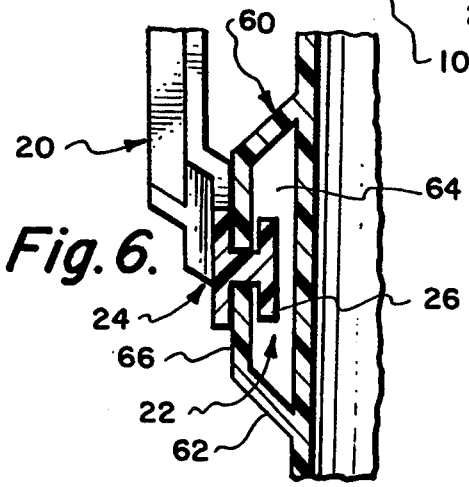
FIG. 6 is a transverse sectional view taken on the broken line 6—6 of FIG. 5.
Figure 7:
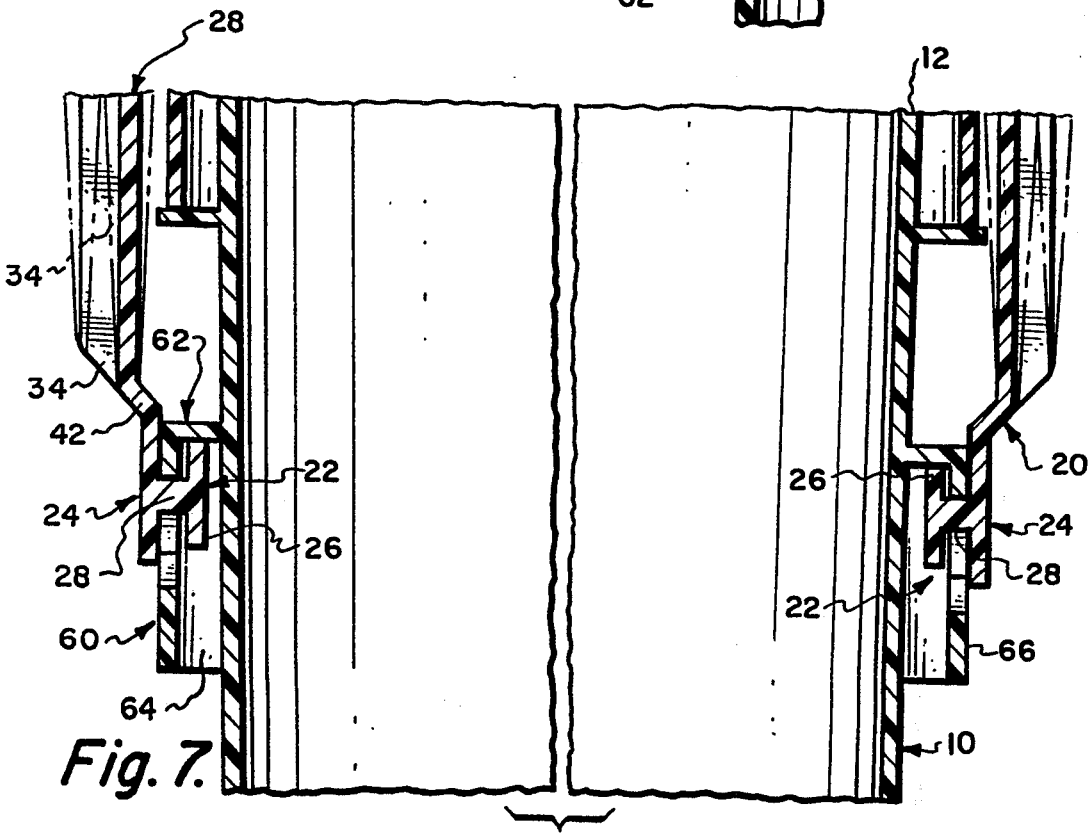
FIG. 7 is an enlarged, fragmentary sectional view showing the relative deflection between the reinforced arms of the bail and the extremities thereof.

After this interference insertion is accomplished, the head underlies a relatively large portion of the vertical wall 66, as best shown in FIG. 10 of the drawings and extreme resistance to inadvertent dislodgement from operative engagement with the retaining means 60 is presented.

Moreover, when the shank 28 of the securement means 22 is forced upwardly into a corresponding interference fit with the reduced locating portion 72, an even greater portion of the head 26 underlies the wall 66 of the socket chamber 64.

Another element in maintaining the securement means 22 in operative relationship with the retaining means 60 is the provision of the flexible connection or interface 42 between the extremities 24 of the bail 20 and the arms 28 thereof as rigidified by the reinforcing ribs 30. As illustrated in phantom in FIGS. 7 and 8, when the bail 20 is subjected to eccentric loading which might cause the displacement of the securement means 22 from the retaining means 60, the interference connection 42 flexes and the arms 28 can flex correspondingly relative to the extremities 24, as indicated at 34 in FIG. 7 and at 34 and 28 by the dash lines.

Therefore, the relatively rigid arms 28 are kinetically isolated by the connecting portion 42 of the arms between the extremities 24 and the arms themselves.

By the interference fit relationship between the securement means 22 and the retaining means 60, elimination of undesirable and inadvertent displacement of the bail 20 from operative relationship with the container 20 is obviated. Furthermore, the built-in flexing of the major portion of the bail with respect to the extremities thereof also tends to isolate loads imposed on the bail arms and the bail itself from the extremities thereof.

While I have disclosed specific configurations of the various components of the invention, it will be obvious to those skilled in the art that variations may be made therein which will still fall within the scope of the appended claims.

I claim:

1. In a bail mounting, the combination of: a bail securement socket including an opening having an enlarged receptor portion and a reduced locating portion; bail securement means on said bail engagable with said bail securement socket and having a head of a first radius and a shank of a second radius, said head engaging said receptor portion, said receptor portion having a lower edge radius corresponding to said first radius and an upper edge having a greater radius than said first radius; and said shank engaging said locating portion having a radius corresponding to said second radius, said head having an engagement surface area larger than said receptor portion and said shank being larger than said locating portion and there being a modulus of deflection between the materials of said head and said receptor opening and between the materials of said shank and said locating opening.

2. The device of claim 1 in which said receptor portion is non-circular and said head is circular.

3. In a container, the combination of: a container body having a base and upwardly extending side wall on said base; bail retaining means oppositely located on the external surface of said wall, said bail retaining means including sockets each having an enlarged receptor opening, said receptor opening having a perimeter with a lower edge of one radius and an upper edge of larger radius, and a reduced locating opening communicating with said receptor opening; and a substantially U-shaped bail having extremities disposable in overlying relationship with said bail retaining means, securement means on said extremities engaged with said bail retaining means, said securement means including an enlarged head having a surface area larger than said receptor opening of said socket and a reduced shank, said shank being larger than said locating opening, said head having its edge conforming to said receptor opening lower edge and there being a modulus of deflection between the materials of said head and said receptor opening and between the materials of said shank and said locating opening.

4. The container of claim 3 in which said shank and said head are of cylindrical and circular configuration respectively.

5. The device of claim 3 in which said receptor opening of said retaining means is non-circular.

6. The device of claim 4 in which said circular head does not conform to the configuration of said receptor opening.

7. The container of claim 3 in which said bail has reinforcing ribs terminating above said extremities.

8. In a container, the combination of: a container body having a base and a sidewall extending upwardly therefrom, said sidewall having bail securement sockets on opposite sides thereof, said sockets including a receptor portion and a locating portion communicating with said receptor portion, the perimeter of said receptor portion including a first radius and a second smaller radius; and a U-shaped bail having its opposite extremities disposable in contiguity to said sockets, said opposite extremities each having socket engaging means thereupon including a head and a shank, said head having a circular edge conforming to said second radius and being smaller than said first radius and being engaged with said receptor portion of said socket to facilitate the forcible entry of said head into said receptor portion by mutual deflection of said edge and said second radius and said shank having an interference fit with said locating portion of said socket, said head and said shank being larger than said receptor and locating portions of said socket, respectively.

9. The container of claim 8 in which said head is circular and said receptor portion of said socket is non-circular.

10. The container of claim 8 in which said bail incorporates reinforcing ribs terminating short of the opposite extremities of said bail.

11. The container of claim 8 in which said bail incorporates hang grip means formed integrally with said bail intermediate the extremities thereof.

* * * * *